US009530298B2

(12) United States Patent
Gruber et al.

(10) Patent No.: US 9,530,298 B2
(45) **Date of Patent: *Dec. 27, 2016**

(54) METHOD AND APPARATUS FOR DETECTING A HAZARD ALARM SIGNAL

(71) Applicant: ECOLINK INTELLIGENT TECHNOLOGY, INC., Carlsbad, CA (US)

(72) Inventors: Brandon Gruber, Vista, CA (US); George Seelman, Temecula, CA (US)

(73) Assignee: Ecolink Intelligent Technology, Inc., Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/793,421

(22) Filed: Jul. 7, 2015

(65) Prior Publication Data

US 2015/0332572 A1 Nov. 19, 2015

Related U.S. Application Data

(63) Continuation of application No. 14/173,445, filed on Feb. 5, 2014, now Pat. No. 9,087,447.

(60) Provisional application No. 61/761,088, filed on Feb. 5, 2013.

(51) Int. Cl.

| | |
|---|---|
| ***G08B 29/00*** | (2006.01) |
| ***G08B 19/00*** | (2006.01) |
| ***G08B 25/14*** | (2006.01) |

(52) U.S. Cl.
CPC ..... *G08B 19/005* (2013.01); *G08B 25/14* (2013.01)

(58) Field of Classification Search
CPC ..... G08B 19/005; G08B 25/14
USPC ..... 340/506
See application file for complete search history.

(56) References Cited

U.S. PATENT DOCUMENTS

| | | | | |
|---|---|---|---|---|
| 5,012,223 | A * | 4/1991 | Griebell | G08B 1/08 340/531 |
| 2006/0250260 | A1* | 11/2006 | Albert | G06F 19/3418 340/628 |
| 2009/0243852 | A1* | 10/2009 | Haupt | G01W 1/00 340/541 |
| 2011/0095896 | A1* | 4/2011 | Lewis | G08B 3/10 340/632 |

* cited by examiner

*Primary Examiner* — Kerri McNally
(74) *Attorney, Agent, or Firm* — Greenberg Traurig, LLP

(57) ABSTRACT

An apparatus and method for detecting a pattern warning signal from a hazard alarm. In one embodiment, a buffer memory is used to store filtered, digitized information from an audio or optical detection device. A processor evaluates the information in the buffer memory to determine when a long lull time occurs between energy peaks present in a sampling of information from the analog-to-digital converter. The results are compared to at least one temporal pattern characteristic to determine if the hazard alarm has detected a hazardous condition.

17 Claims, 6 Drawing Sheets

METHOD AND APPARATUS FOR DETECTING A HAZARD ALARM SIGNAL

CROSS-REFERENCE TO RELATED APPLICATION(S)

The present application is a continuation of U.S. patent application Ser. No. 14/173,445, filed on Feb. 5, 2014, which claims priority to U.S. provisional application Ser. No. 61/761,088 filed on Feb. 5, 2013, both of which are incorporated by reference herein in their entirety.

BACKGROUND

I. Field of the Invention

The present invention relates to home security and, more particularly, to a method and apparatus for audible/visual detection of conventional consumer smoke or carbon monoxide detectors.

II. Description of Related Art

Many homes and businesses contain hazard alarms for detecting the presence of smoke and/or carbon monoxide. Such detectors are typically purchased by consumers at the retail level and installed in their homes and businesses. When a fire or excess carbon monoxide is detected, these detectors typically emit a piercing siren and/or visual effect (e.g., flashing light). However, older people often have hearing or mobility difficulty and remain at a significantly increased risk of injury even if the audible alarm sounds.

Home security monitoring vendors such as Ackerman or ADT™ offer networked detectors and failsafe deployment of first responders. Again, when an alarm condition is detected, these systems emit an audible local alarm and also send an alarm code to a central panel for alerting a remote monitoring station, which in turn dispatches proper authorities to the location where the alarm condition exists. However, these network detectors are typically system-specific, and are installed by a third party along with other detectors such as door and window monitors for unauthorized entry. These network systems and their dedicated alarms are expensive and not generally used for middle and low income housing.

Inexpensive consumer smoke or carbon monoxide detectors cannot communicate with home security systems, or vice versa, since these consumer-grade detectors generally lack the capability to wirelessly communicate with a centrally-located security panel. Further, most wireless security panels use proprietary protocols to reduce the ability for third party products to communicate with these panels. Consequently, when a consumer smoke or carbon monoxide detector sounds an alarm and no one is present inside the home, the alarm will not be acted on.

Consequently, there remains a need for an apparatus that would enable network monitoring of consumer-level fire and carbon monoxide alarms.

SUMMARY

Accordingly, it is an object of the present invention to provide a method and device for audibly and/or visually detecting activation of a conventional consumer smoke or carbon monoxide detector and for communicating that fact to a network security system for communication with a remote monitoring station.

It is another object to accomplish the foregoing in an environment where multiple different alarm types may be activated at once, and to be able to discriminate the different alarm types.

It is another object to accomplish the foregoing with a digital processor-based circuitry and a buffer for storing digital samples on a FIFO basis and for analyzing a contiguous subset of the digital samples stored in buffer memory to detect each cadence patterns.

In accordance with the foregoing and other objects, the present invention comprises a method and apparatus for detecting an audible and/or visual alarm, typically in the form of a pattern warning signal, generated by one or more hazard alarms, and in response thereto sending an alert signal to a home security panel for notification to a remote monitoring station. Such an apparatus generally comprises an audio and/or visual detection device for converting such pattern warning signals to an analog signal, providing amplification and filtering to the analog signal, then converting it to a digital signal for evaluation by a processor.

BRIEF DESCRIPTION OF THE DRAWINGS

Other objects, features, and advantages of the present invention will become more apparent from the following detailed description of the preferred embodiments and certain modifications thereof when taken together with the accompanying drawings in which.

DETAILED DESCRIPTION

The present disclosure describes a method and apparatus for audibly or visually detecting activation of one or more conventional consumer smoke, fire and/or carbon monoxide detectors, and for communicating that fact to a home security system for communication with a remote monitoring station.

Figure 1:
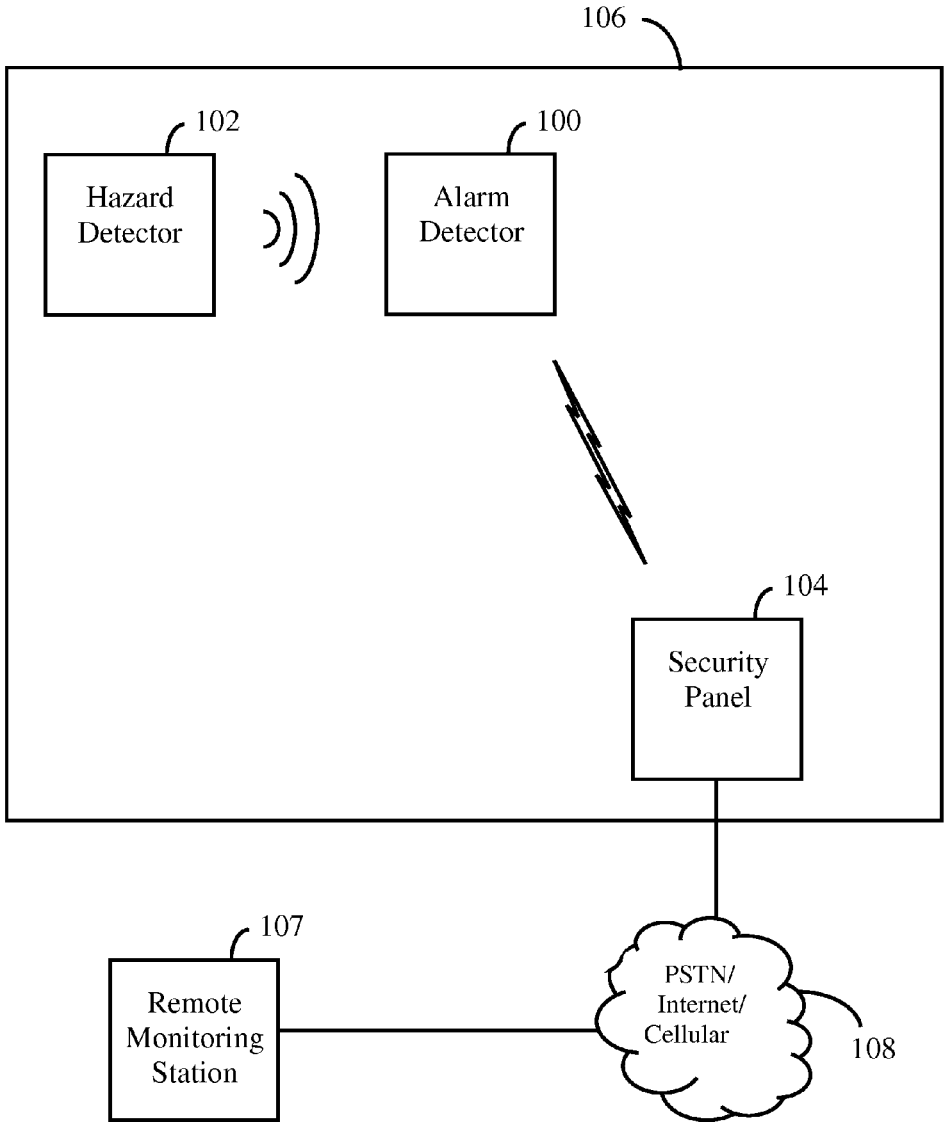
FIG. 1 illustrates one embodiment of a system for providing a hazard alert to a remote monitoring station using an alarm detector for detecting a hazard alarm in accordance with the teachings herein.
Figure 4:
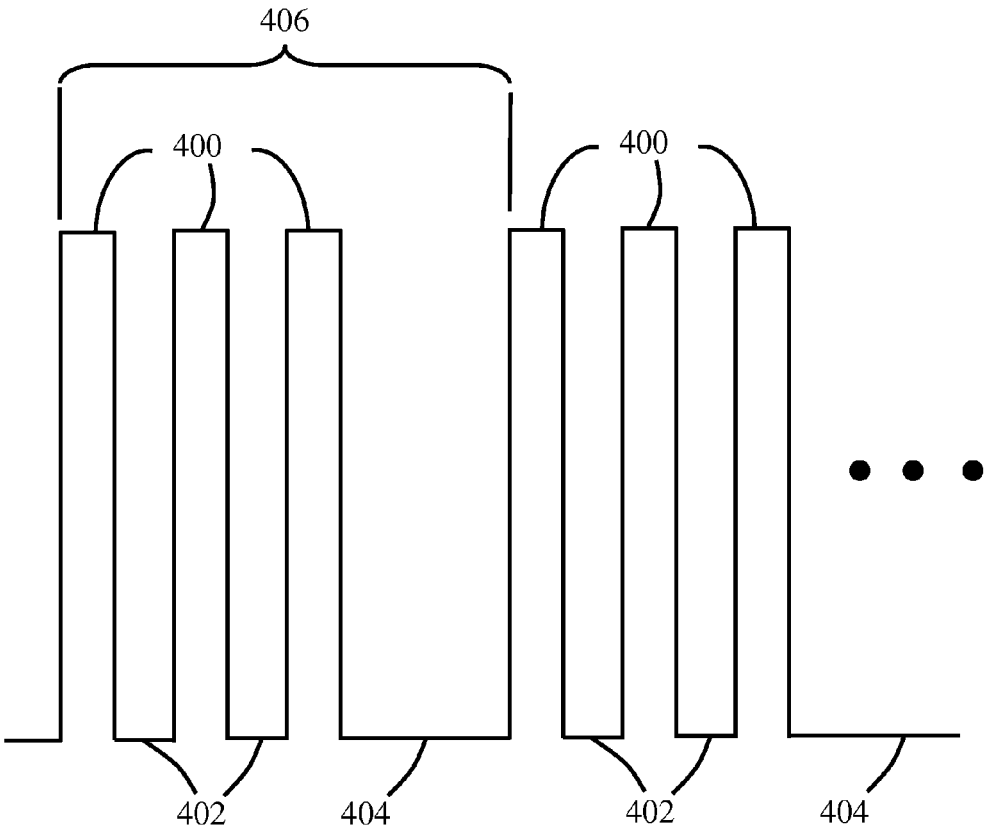
FIG. 4 illustrates a typical T-3 temporal pattern.
Figure 5:
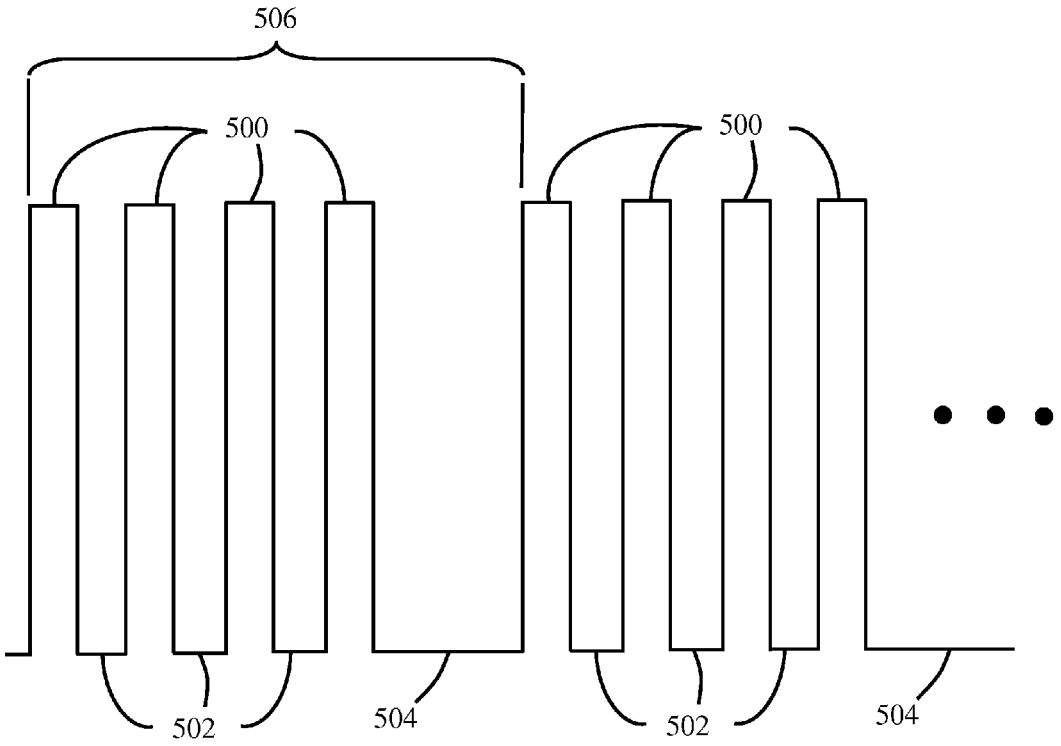
FIG. 5 illustrates a typical T-5 temporal pattern.

FIG. 1 illustrates one embodiment of an alarm detector 100 for detecting the presence of an audio and/or visual alert in a home or business 106, typically in the form of a pattern warning signal, generated by hazard alarm 102 when a hazardous condition has been detected by hazard alarm 102, and for transmitting an alarm signal to a home security panel 104 for communication to a remote monitoring station 107 via a network 108, such as a PSTN, Wide Area network, such as the Internet, and/or cellular voice and/or data network. The term "pattern warning signal" as used herein refers to an audible or visual signal that comports to temporal pattern, such as an ISO 8201 and/or ANSI/ASA S3.41 temporal pattern, presenting the audible or visual signal in a series of timed "pulses" of sound or light. Most smoke detectors manufactured today comport to the ISO/ANSI/ASA standard, which requires an interrupted four count (three half second audio or visual pulses, followed by a one and one half second pause, commonly repeated for a minimum of 180 seconds). This is commonly known as a "Temporal Three" or T-3 pattern. Similarly, modern carbon monoxide detectors comport to a "Temporal Four" or T-4 format, comprising an interrupted five count (four half second audio or visual pulses, followed by a one and one half second pause). Thus, a type of hazard can be determined by knowing whether an alarm signal comprises a T-3 or a T-4 temporal pattern. FIG. 4 illustrates a typical T-3 temporal pattern, while FIG. 5 illustrates a typical T-5 temporal pattern, each illustration showing a repeating, time-varying voltage comprising "pulses" or "peaks" 400/500. These pulses represent an "envelope" of a high-frequency signal corresponding to a high-frequency audible tone produced by hazard alarm 102 if it has detected a hazard condition. The temporal characteristic comprises a number of pulses, followed by a "long lull period", shown in FIGS. 4 and 5 as long lull period 404 and 504, respectively.

The hazard alarm 102 may comprise any one or more of a smoke detector, fire detector, carbon monoxide detector, natural gas detector, radon detector, or any other device that detects one or more hazardous conditions. For example, hazard alarm 102 may comprise a model KID442007 smoke detector manufactured by Kidde, Inc. of Mebane, N.C. and/or a carbon monoxide detector such as model C0400, manufactured by First Alert, Inc. of Aurora, Ill., or a model KN-COSM-B combination smoke detector and carbon monoxide detector also manufactured by Kidde. Hazard alarm 102 is typically battery-operated and generally has no native capability to send or receive wireless communication signals of any type, other than by audible warning and/or visually by illuminating a light that is part of hazard alarm 102.

Security panel 104 is part of an overall security system for a home or business, for example, a Safewatch QuickConnect™ system sold by ADTTM of Boca Raton, Fla. Typically, these home security systems monitor door and windows of a home or business to detect unauthorized entry. If an unauthorized entry is detected by a sensor, an indication of the entry is transmitted to security panel 104, which in turn may emit an audible and/or visual alert, and/or send an alarm signal to remote monitoring station 107 so that the proper authorities may respond to the alarm condition.

Alarm detector 100 comprises a combination of hardware and software that determines when hazard alarm 102 has been activated (e.g., has detected a hazard condition such as smoke, fire, and/or carbon monoxide, etc.) and, in response, transmits an alarm signal to security panel 104 so that security panel 104 may transmit a signal to the remote monitoring station 107.

Alarm detector 100 generally comprises an audio detector including one or more microphones or other suitable audio transducers to detect an audible signal emanating from hazard alarm 102 and to convert same to an analog signal. Preferably, audio detector 204 comprises one or more conventional piezo microphones, typically small in size and well known in the art. In one embodiment, an array of two or more microphones are used in order to provide differential sound detection. This enhances the ability for alarm detector 100 to detect audio signals from hazard alarm 102 in an environment where the audio signals bounce off of walls, furniture, etc. This overcomes a problem where the reflected audio signals combine at the audio detector along with the original audio signal from the audio detector to form audio wave patterns whose amplitude rises and falls as the reflected audio signals combine with each other and the original signal emanating from the hazard alarm 102. Using two or more microphones enables spatial-diversity to occur, thus increasing the ability of alarm detector 100 to detect an audio signal that may be tainted with such reflected signals.

Alarm detector 100 may, alternatively or in addition, comprise a visual detection device including one or more photo-sensitive LEDs or other suitable device(s) capable of sensing illumination produced by hazard alarm 102 in response to hazard alarm 102 detecting a hazard condition. Such illumination may be turned on and off, or modulated, to produce a pattern warning signal in conformance with a T-3 or T-4 cadence.

If hazard alarm 102 detects a hazard condition, it typically will emit a high-decibel pattern warning signal with standardized parameters including frequency, volume, and cadence.

The pattern warning signal emitted by hazard alarm 102 comprises an audible signal usually around 3200 Hz at 45 dB to 120 dB, weighted for human hearing. The pattern warning signal typically complies with the well-known Temporal-Three alarm signal, often referred to as T3 (ISO 8201 and ANSI/ASA S3.41 Temporal Pattern) which is an interrupted four count (three half second pulses, followed by a one and one half second pause, repeated for a minimum of 180 seconds). CO2 (carbon monoxide) detectors are specified to use a similar pattern using four pulses of tone (often referred to as temporal-4 or T4).

Alarm detector 100 detects the presence of sound and/or light emanating from one or more hazard alarms 102 by evaluating the decibel level, frequency, cadence, and/or other characteristics of the signals.

For example, in the embodiment of FIG. 1, the audio detector of alarm detector 100 receives the audio signal produced by hazard alarm 102, and then determines whether the audio signal comports to, for example, an audio signal having a T-3 or T-4 temporal characteristic or cadence. If so, alarm detector 100 transmits a signal to security panel 104, using wired or wireless communication methods, indicating that one or more hazards have been detected. Preferably, alarm detector 100 is configured to distinguish the type of alarm condition based on the type of signal detected from hazard alarm 102. For example, if a T-3 cadence is detected, alarm detector 100 may transmit a signal to security panel 104 indicating that a smoke or fire hazard has been detected. If a T-4 cadence is detected, alarm detector 100 may transmit a signal to security panel 104 indicating that a carbon monoxide hazard has been detected.

Security panel 104 is programmed to contact a remote monitoring station 107 upon receipt of a signal from alarm detector 100 or from any of the door or window sensors, to inform the remote monitoring station that an alarm condition has been detected and, in one embodiment, an indication of the type of alarm, such as smoke, carbon monoxide, etc.

Figure 2:
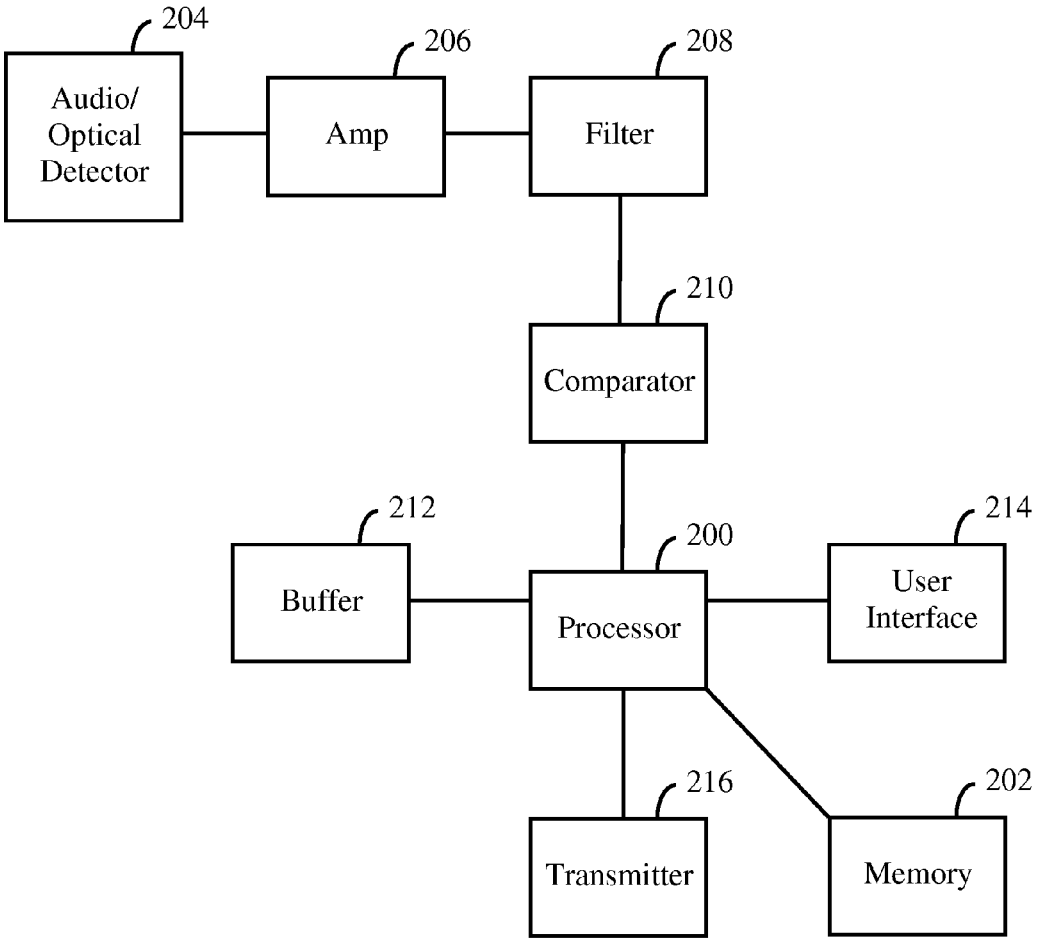
FIG. 2 is a functional block diagram of the alarm detector of FIG. 1.

FIG. 2 is a functional block diagram of one embodiment of alarm detector 100. In this embodiment, alarm detector 100 comprises a processor 200, a memory 202, an audio and/or optical detector 204, an amplifier 206, a filter 208, a comparator 210, a buffer 212, a user interface 214, and a transmitter 216. It should be understood that not all of the functional blocks shown in FIG. 2 are required for operation of alarm detector 100 in all embodiments (for example, amplifier 206 or buffer 212), that the functional blocks may be connected to one another in a variety of ways, that additional function blocks may be used (for example, additional amplification or filtering), and that not all functional blocks necessary for operation of the alarm detector 100 are shown for purposes of clarity, such as a power supply.

Processor 200 is configured to provide general operation of alarm detector 100 by executing processor-executable instructions stored in memory 202, for example, executable code. Processor 200 typically comprises a general purpose processor, such as an ADuC7024 analog microcontroller manufactured by Analog Devices, Inc. of Norwood Mass., although any one of a variety of microprocessors, microcomputers, microcontrollers, and/or custom ASICs suitable for use in a power-limited, limited space design may be used alternatively.

Memory 202 comprises one or more information storage devices, such as RAM, ROM, EEPROM, UVPROM, flash memory, SD memory, XD memory, or virtually any other type of electronic, optical, or mechanical memory device. Memory 202 is used to store the processor-executable instructions for operation of alarm detector 100 as well as any information used by processor 200 to detect whether an audio and/or optical pattern warning signal has been generated by hazard alarm 102. Memory device 202 could, alternatively or in addition, be part of processor 200, as in the case of a microcontroller comprising on-board memory.

Audio/optical detector 204 comprises one or more microphones or other suitable audio transducers to detect an audible signal emanating from hazard alarm 102 and to convert same to an analog signal. Preferably, audio/optical detector 204 comprises one or more conventional piezo microphones, typically small in size and well known in the art. In one embodiment, an array of two or more microphones is used in order to provide differential sound detection. This enhances the ability for alarm detector 100 to detect audio signals from hazard alarm 102 in an environment where the audio signals bounce off of walls, furniture, etc.

Audio/optical detector 204 may also comprises an optical detector comprising one or more photo-sensitive LEDs or other suitable device(s) capable of sensing an illumination signal produced by hazard alarm 102 in response to hazard alarm 102 detecting a hazard condition.

Amplifier 206 comprises circuitry used to amplify the magnitude of the analog signal from audio/optical detector 204 to a level suitable for filter 208 to process. Amplifier 206 may comprise one or more of any number of well-known amplifiers, such as in the form of discreet components (e.g., one or more transistors, op-amps, resistors, capacitors, etc.), an integrated circuit, or part of a custom ASIC. In one embodiment, amplifier 206 amplifies the signal from audio/optical detector 204 by a factor of 40, resulting in a signal to filter 208 between 0 and the voltage limit of the amplifier, typically 3 volts.

Filter 208, in one embodiment, comprises a bandpass filter centered at a frequency equal to a frequency of the pattern warning signal. For example, filter 208 may comprise a Chebyshev filter, centered at 3.1 kHz, as many smoke or carbon monoxide detectors in use emit an audio pattern warning signal at 3.1 kHz, with some variation expected. In other embodiments, filter 208 could alternatively comprise a highpass filter or a lowpass filter. The bandpass of filter 208 is wide enough to allow for such variation between different smoke/carbon monoxide detectors, such as a bandpass of 2 kHz, but narrow enough to attenuate any extraneous audible signals, such as sound from TVs, people, animals, and generally sounds other than the audio pattern warning signal from hazard alarm 102. Filter 208 may comprise discreet components such as one or more transistors, op-amps, resistors, capacitors, etc., an integrated circuit, or part of a custom ASIC.

The output from filter 208 is provided to comparator 210. Comparator 210 is used to present digital "1"s and "0"s to processor 200 for use in determining whether a pattern warning signal is present. Typically, a fixed DC voltage is also presented to comparator 210 for comparison to the signal from filter 208. The fixed DC voltage is selected at some point greater than the mid-point between the voltage supplied to comparator 210 and ground, or between two supply voltages. The voltage may be selected by such factors as the decibel level of hazard alarm 102, the location of hazard alarm 102 in proximity to alarm detector 100, the gain of amplifier 206, the type of audio/optical detector 204, other factors, or a combination thereof, in order to present a signal within the input voltage range of processor 200. When a voltage greater than the threshold voltage is presented to comparator 210, a digital "1" is produced, and when the voltage to comparator 210 is less than the threshold voltage, a digital "0" is produced. The threshold voltage is chosen high enough so that a small magnitude sound wave presented to audio/optical detector 204 result in a "0", such as sounds from a TV or conversation, or even by loud sounds (e.g., dog barking, boiling tea kettles) located some distance away from hazard alarm 102. Additionally, the threshold voltage is chosen low enough to ensure that large magnitude sound waves presented to audio/visual detector 204, such as those from hazard alarm 102 in close proximity to alarm detector 100, results in a "1" being produced. In this way, comparator 102 acts like a one-bit, variable-threshold A/D converter, converting an analog signal from filter 210 to a digital signal determined by the voltage level of the analog signal compared to the threshold voltage.

Buffer 212 comprises one or more information storage devices, such as a RAM memory, or other type of volatile electronic, optical, or mechanical memory device. Buffer 212 could, alternatively or in addition, be part of processor 200, as in the case of a microcontroller comprising on-board memory, or a custom ASIC. Buffer 212 is used to store the digital information generated by comparator 210. Buffer 212 includes a predetermined number N memory locations each configured to store a digital value from comparator 210, and as all N locations become populated with digital information, new samples begin replacing the oldest samples in a first-in-first-out (FIFO) manner. In one embodiment, the use of DMA by processor 200 allows storage independent of the processes being executed by processor 200, effectively freeing processor 200 to perform other functions as digital information from comparator 210 is generated. The number of memory locations comprising buffer 212 will vary in one embodiment vs. another, as will be described later herein. Typically, digital information generated by comparator 210 is stored in buffer 212 at predetermined time intervals, for example every 20 milliseconds.

User Interface 214 may be provided which generally comprises hardware and/or software necessary for allowing a user of alarm detector 100, such as a homeowner, to perform various tasks such as to check the status of a battery, send a test signal to the security panel 104, put the alarm detector 100 into a particular mode of operation such as "armed mode" where alarm detector 100 transmits a signal to security panel 104 upon detection of an audible/visual alarm produced by hazard alarm 102, among others. Such hardware and/or software may comprise switches, pushbuttons, touchscreens, and other well-known devices.

Transmitter 216 comprises circuitry necessary to transmit signals from alarm detector 100 to one or more remote destinations, such as security panel 104 and/or some other remote entity, such as to a cellular network for delivery to a personal communication device, such as a wireless smartphone. Such circuitry is well known in the art and may comprise BlueTooth, Wi-Fi, Sigsbee, X-10, Z-wave, RF, optical, or ultrasonic circuitry, among others. Alternatively, or in addition, transmitter 216 comprises well-known circuitry to provide signals to a remote destination via wiring, such as telephone wiring, twisted pair, two-conductor pair, CAT wiring, or other type of wiring.

Figure 3:
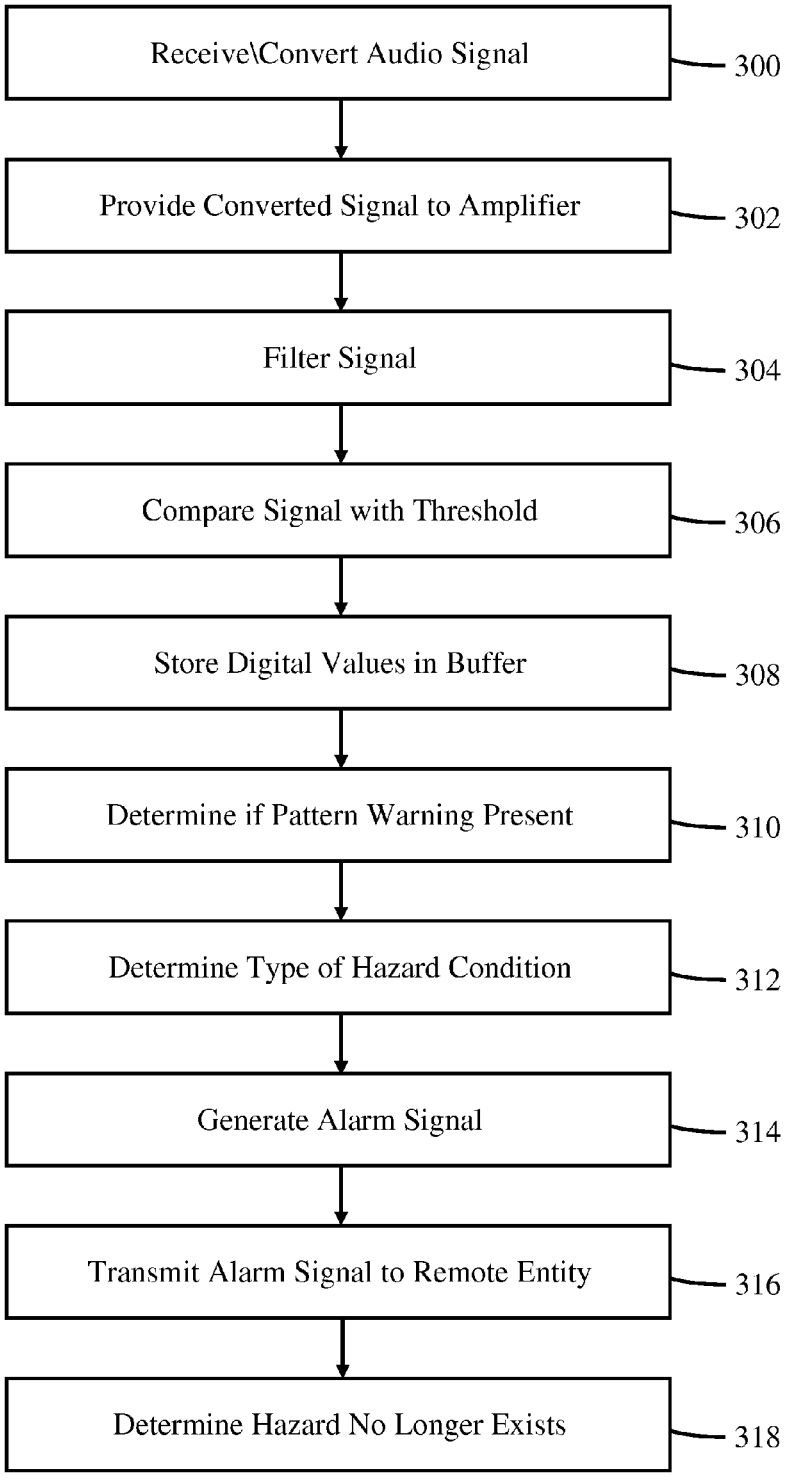
FIG. 3 is a flow diagram illustrating one embodiment of alarm detection and transmission.

FIG. 3 is a flow diagram illustrating one embodiment of alarm detection and transmission. The method is implemented by processor 200 executing processor-readable instructions stored in the memory 202 shown in FIG. 1. It should be understood that in some embodiments, not all of the steps shown in FIG. 3 are performed and that the order in which the steps are carried out may be different in other embodiments. It should be further understood that some minor method steps have been omitted for purposes of clarity. Finally, it should be understood that although much of the discussion related to FIG. 3 references audible signals sensed by an audio detector only, it is intended that such discussion additionally relate to light signals and the use of optical detectors either additionally, or in the alternative.

The process begins at block 300, where the audio/optical detector 204 receives audio signals in the form of sound pressure waves from the general surroundings where alarm detector 100 is located and audio signals from hazard alarm 102 if hazard alarm 100 has detected a hazard condition. These audio signals are converted into analog signals and provided to amplifier 206. In another embodiment, audio/optical detector 204 comprises means for detecting light signals produced by hazard alarm 102, such as one or more photodiodes, phototransistors, or other light-sensitive devices. In one embodiment, the photodiodes, phototransistors, or other light-sensitive devices are chosen to detect light signals in a frequency range produced by a typical hazard alarm 102. In any case, audio/optical detector 204 converts the optical signals into electronic signals for use by amplifier 206. In an embodiment where audio/optical detector 204 comprises both an audio detector and an optical detector, two streams of analog signals are produced and processed separately, in one embodiment, by adding another amplifier, filter, and comparator similar to amplifier 206, filter 208, and comparator 210 and providing the output of the second comparator to processor 200.

At block 302, the analog signal from audio/optical detector 204 is provided to amplifier 206, where amplifier 206 amplifies the magnitude of the electronic analog signal. In one embodiment, the electronic analog signal is amplified by a factor of 40. In other embodiments, an automatic gain control feature may be incorporated into the circuitry of amplifier 206, to maintain a signal that is within a usable voltage range of filter 208. In some cases, amplifier 206 may actually attenuate the analog signal if, for example, hazard alarm 102 is located very close to alarm detector 100 and/or the audible signal from hazard alarm 102 is very loud. In any case, the amplified analog signal is the provided to filter 208.

At block 304, filter 208 attenuates frequencies in the amplified analog signal outside the passband of filter 208 to produce a filtered, amplified, analog signal. The passband center frequency and bandpass are selected to attenuate sounds other than those produced by hazard alarm 102.

At block 306, the filtered, amplified, analog signal is provide to comparator 210, where it is compared with a threshold voltage that is also provided to comparator 210, as discussed previously. Comparator 210 converts the filtered, amplified, analog signal into a digital signal comprising digital "1"s and "0"s and provides the digital signal to processor 200. Alternatively, the digital signal may be stored directly into buffer 212, rather than provided to processor 200.

At block 308, in one embodiment, processor 200 receives the digital signal from comparator 210 and stores digital samples from the digital signal into buffer 212 in a first-in, first-out (FIFO) manner, as discussed previously. In one embodiment, the digital samples are stored using DMA that allows storage of the digital samples independent of other processes executed by processor 200, effectively freeing the processor 200 to determine if a pattern warning signal has been received based on the digital samples stored in buffer 212. In one embodiment, buffer 212 comprises 64 memory locations, and processor 200 stores each new digital sample in a first memory location, while shifting any previously-stored digital samples to a next respective, adjacent memory location. When buffer 212 is full, processor 200 continues storing new data samples in the first memory location and shifting each of the previously-stored digital samples to the next, sequential memory location, causing the last digital sample in buffer 212 to be ejected from buffer 212. Thus, buffer 212 acts as an evaluation window of time equal to the number of memory locations multiplied by the rate at which digital samples are added to buffer 212. For example, if buffer 212 comprises 100 memory locations and processor 200 stores digital samples at a rate of one sample every 20 milliseconds, buffer 212 essential captures a 2 second window of time (100 memory locations times 20 milliseconds) of audio information received by audio/optical detector 204.

At block 310, in one embodiment, processor 200 determines if a pattern warning signal has been received based on some or all of the digital samples stored in buffer 212, in some embodiment, over a predetermined time period. In one embodiment, processor 200 evaluates some or all the digital samples stored in buffer 212 at predetermined time periods, such as once every 20 milliseconds, every 30 milliseconds, or some other time period typically at least an order of magnitude less than the period of the temporal signal, shown in FIG. 4 as temporal pattern period 406 and in FIG. 5 as period 506. Taking periodic sample of some or all of buffer 212 acts as a low-pass filter, smoothing the output of comparator 210 due to noise at the comparator's input.

In one embodiment, processor 200 assigns a "1" or "high" buffer state to the signal provided by comparator 210 when the number of "1"s stored in these memory locations exceeds a first predetermined threshold number, or if a predetermined percentage of memory locations contain a digital "1" (i.e., 75% of the number of digital values read, or a numerical value, such as 50 memory locations or, conversely, whether a percentage of "0"s in the sampled memory locations is less than a second predetermined threshold such as 25% or 50 memory locations). In one embodiment, processor 200 samples enough memory locations in buffer 212 to cover the period of a temporal signal. In one embodiment, all of the memory locations are evaluated by processor 200. If the number or percentage of "1"s in buffer 212 exceed the threshold, this is indicative of the presence of energy within the passband of filter 208, which in turn indicates that a first pattern warning signal is sounding from hazard alarm 102, for example an audible alarm signal that follows a T-3 cadence, indicating the presence of a first hazard condition, such as the presence of smoke. Alternatively, or in addition, processor 200 evaluates the digital samples at predetermined time intervals to determine if the number or percentage of "1"s in the sample exceeds a third predetermined threshold (i.e., 85% of the number of digital values read, or a numerical value, such as 70 memory locations or, conversely, whether a percentage of "0"s in the sampled memory locations is less than a fourth predetermined threshold such as 25% or 70 memory locations). If so, this is indicative that a second pattern warning signal is sounding from hazard alarm 102 (or from a different hazard alarm), for example an audible alarm signal that follows a T-4 cadence, indicating the presence of a second hazard condition, such as the presence of an abnormal level of carbon monoxide. In the just-described embodiment, the sampling rate of comparator 210 and the period of the temporal signal may be used to select the size, or number of memory locations, of buffer 212. For example, in this embodiment, it is desirable to evaluate enough samples to cover at least one period of the temporal signal. If the period is 5 seconds, and the sampling rate is 20 milliseconds, buffer 212 would be selected to be at least 250 memory locations, or bits, long. In another embodiment, processor 200 does not determine that a hazard alarm has been detected until processor 200 determines that a predetermined number of "high" buffer states have occurred within a predetermined time period or that a predetermined number of "high" buffer states have occurred consecutively.

In another embodiment, processor 200 reads or samples some or all of buffer 212 at predetermined time intervals, assigns a buffer state or digital value to each sample, determine the occurrence of "events" based on the samples, and then compare the events to one or more temporal pattern characteristics to determine if a pattern warning signal is present.

A first "event" can be defined as a predetermined percentage or number of memory locations in a sample having a "1" stored therein, indicating energy within the passband of filter 208, for example a percentage greater than 70%. A second event could be defined as a predetermined percentage or number of memory locations having a "0" stored therein, indicating a minimal, or no, energy inside the passband of filter 208, for example a percentage less than 30% (of course, the assignment of events could be reversed, e.g., the first event defined as a predetermined number of percentage of memory locations contain a "0" and the second event defined as a predetermined number of percentage of memory locations contain a "1"). Other events can be defined by combining the events described and/or by combining the events described above with time. For example, events such as the following could be defined:

Third Event: a first event followed by another first event (indicates continued energy within the passband)

Fourth Event: a first event followed by a second event (indicates energy in the passband followed by minimal, or no, energy in the passband)

Fifth Event: a second event followed by a first event (indicates a minimal, or no, energy in the passband followed by energy present in the passband)

Sixth Event: a second event followed by a second event (indicates continued minimal, or no, energy in the passband)

Seventh Event: the fourth event, followed by a number of second events, followed by either a first event or the fifth event Of course, many other events could be defined and not all of the events described above are necessary for the operation of pattern warning detection in this embodiment. Processor 200 may also determine a time that each event occurs and record the event and the time that each event occurred in memory 202. It should also be understood that while use of "events" may simplify and/or reduce processing necessary by processor 200, in other embodiments, the use of events is not used. In these cases, processor 200 may make state determinations of the samples from buffer 212 and then compare the determinations with each other and/or to time in order to determine whether the output of comparator 210 comports to one or more characteristics of a pattern warning signal.

If events are used, processor 200 can compare events to one or more characteristics of a temporal pattern stored in memory 202 to determine when a pattern warning signal is present.

The characteristics may comprise one or more of a) three energy peaks within a predetermined time period, b) four energy peaks within a predetermined time period, c) three (or four) energy peaks within a predetermined time, each peak having a duration of a predetermined time, d) a "long lull time period" having a duration substantially equal to long lull 404 or 504 in FIGS. 4 and 5, respectively (i.e., a lack of energy in the passband between two detections of energy in the passband), e) a temporal pattern period (e.g., period 406 or 506), measured by one or more re-occurrences of any one or more of items a-d. Of course, a number of other temporal pattern characteristics could be used, either alternatively or in conjunction with the aforementioned characteristics, to determine whether a pattern warning signal is present.

Figure 6:
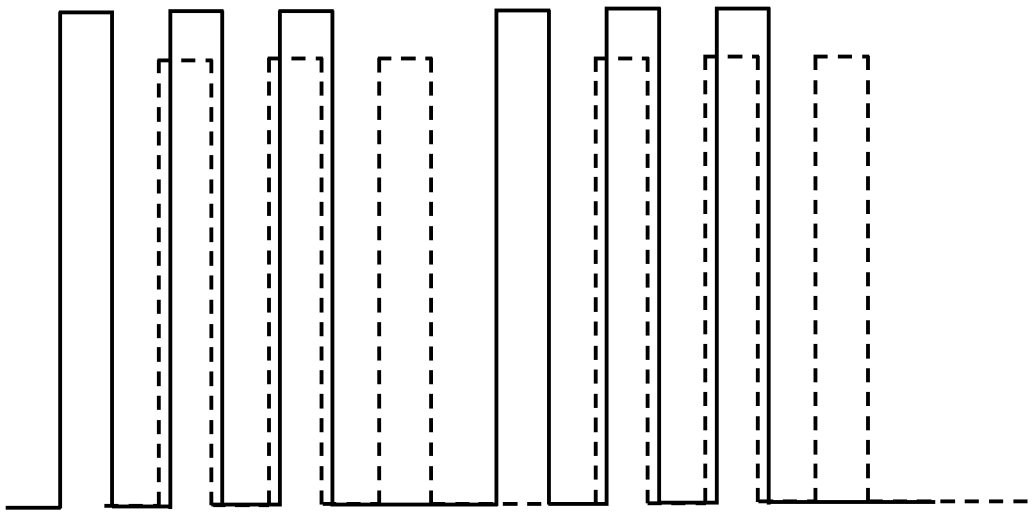
FIG. 6 illustrates two overlapping temporal patterns that are out of phase from one another.

For example, in one embodiment, processor 200 determines whether a pattern warning signal is present by determining whether the output of comparator 210, or the buffer states, substantially matches a long lull time of a temporal pattern, such as a T-3 or T-4 pattern. Typically, the long lull time is such patterns is one and a half (1.5) seconds. This greatly simplifies the process of determining whether the output from comparator 210 matches a temporal pattern, because only one characteristic need be examined. This embodiment may be particularly useful to eliminate problems of detection due to the presence of a second pattern warning signal from a second hazard alarm 102 located some distance away from a first hazard alarm 102 located closer to alarm detector 100. In this case, two overlapping temporal patterns may make it difficult to determine the presence of one of the temporal audio patterns using the techniques previously discussed (such as peak or pulse detection, temporal pattern period detection, width of pulses or peaks, etc.), because the peak and lull times of each temporal signal overlap, as shown in FIG. 6. In FIG. 6, a first temporal pattern is shown in solid lines and a second temporal pattern is shown in dashed lines, the second temporal pattern having an amplitude that is less than the amplitude of the first temporal pattern. The signals shown in FIG. 6 may be representative of the signal from comparator 212, in which case both temporal signals are being processed simultaneously. This causes difficulty in determining the timing characteristics of a temporal pattern, such as 3, half-second peaks, followed by a longer lull time, such as one and a half seconds, because of the interfering nature of the overlapping signals. Fortunately, the phase of each hazard alarm 102 is typically not the same. So, over a relatively short time period, on the order of minutes, two temporal signals from two different hazard alarms may briefly be in-phase with each other, allowing alarm detector 100 to determine that at least one temporal signal is present, simply by detecting the long lull period.

Processor 200 may use events to determine when a long lull period has occurred, or it can determine individual states of buffer 212 and match the buffer states to the long lull characteristic. For example, after determining that buffer 212 has transitioned from a high buffer state to a low buffer state, processor 200 may determine that buffer 212 has transitioned from a low buffer state to a high buffer state at some later time. Upon occurrence of the transition from low to high, processor 200 may determine the elapsed time between the first transition and the second transition and compare that time to the long lull time associated with either a T-3 temporal pattern or a T-4 temporal pattern as shown in FIGS. 4 and 5 as long lull 404 and 504, respectively, in one embodiment, 1 and a half seconds. If the elapsed time between the transitions is substantially equal to the long lull time (e.g., +/−10%), processor 200 declares that either a T-3 or a T-4 signal is present. In one embodiment, processor does not declare that a T-3 or a T-4 signal is present unless at least two long lulls periods are detected, spaced apart in time from one another by a time approximately equal to a temporal pattern period 406 or 506 of either a T-3 or a T-4 signal. For instance, in a typical T-3 signal, the temporal time period is approximately 4 seconds. A typical T-4 signal comprises a temporal time period of approximately 5 seconds. Therefore, processor 200 will only declare a T-3 signal present if two long lulls occur about 4 seconds from each other, and a T-4 only if two long lulls occur about 5 seconds from each other.

Of course, in other embodiments, processor 200 can determine other characteristics of a temporal pattern, alternatively or in addition to the long lull as described above. For example, processor 200 could determine when one or more "pulses" or "peaks" occur, shown in FIG. 4 as pulses 400 and in FIG. 5 as pulses 500, and the relative times between such pulses. Thus, if processor 200 determines that three pulses have occurred, each spaced 1 second apart, a T-3 temporal pattern could be declared. Various combinations of temporal characteristics could be used by processor 200 to determine whether a temporal pattern has occurred, using the events determined by the buffer sampling described above. For example, a temporal pattern could be declared if just one pulse is detected, followed by a long lull within the period of either a T-3 or T-4 temporal pattern.

In another embodiment, buffer 212 is not used. Rather, processor 200 determines whether one or more pattern warning signals are present by periodically sampling comparator 210, such as once every 20 milliseconds. When a "1" is present, indicating energy within the passband of filter 208 (or, alternatively, when an uninterrupted, or nearly uninterrupted, sequence of "1"s are received, for example 5 consecutive "1"s), processor 200 starts a clock (implemented in either hardware or, more typically, software). In another embodiment, sampling by processor 200 continues until a "0" is received, indicating that no audio signal from hazard alarm 102 is present. A second clock may be started at this point. Processor 200 determines the elapsed time between when the "1" was detected and the time when the first "0" was detected in order to determine if the time that the output of comparator 210 was high matches to a "pulse" characteristic of a temporal signal, shown in FIGS. 4 and 5 as pulse 400 and pulse 500, respectively. In another embodiment, processor may wait to make the elapsed time measurement until a predetermined number of "0"s are generated sequentially by comparator 210, such as five samples, to ensure that signal has, indeed, dropped off, in order to prevent false readings due to, for example, transient events such as noise.

When a "0" is detected from comparator 210 after detecting a "1", processor 200 determines the elapsed time from when the "1" was first determined, and compares the elapsed time to an expected time period of a temporal signal pulse, for example, one-half second (shown as pulse 400 and pulse 500) as stored in memory 202. Similarly, processor 200 continues to evaluate the output of comparator 210 to determine how long an uninterrupted (or nearly uninterrupted) sequence of "0"s occur after start of the second clock, to determine if the signal from comparator 210 remains low for a time period corresponding to a lull 402/502 in a temporal pattern, such as one-half second. Processor 200 continues to monitor the output of comparator 210, using clocks to determine time periods of pulses and lulls, then matches the results to determine if a pattern warning signal is being emitted by hazard alarm 102. For example, processor 200 may indicate the presence of a pattern warning signal when the output of comparator 210 has followed one or more T-3 or T-4 temporal patterns. For example, processor 200 may require 2 full periods of a temporal pattern before it declares that a pattern warning signal is present.

In another embodiment where buffer 212 is not used, processor 200 determines whether one or more pattern warning signals are present by, again, periodically sampling comparator 210, such as once every 20 milliseconds, to determine if a "long lull" period of a temporal patter is present, e.g., long lull 404 or long lull 504. In this embodiment, processor 200 evaluates the output of comparator 210 to determine if the "long lull" characteristic of a T-3 or T-4 signal is present. This is accomplished by noting a change in state of comparator 210 from a "1" to a "0", then either starting a clock or counting the number of uninterrupted (or nearly uninterrupted) "0" that occur after the transition from "1" to "0". When processor 200 determines that the output of comparator 210 has changed from a "0" to a "1" after detecting the change from "1" to "0", the elapsed time between this event and the change from "0" to "1" is determined then compared to an expected lull time of a temporal signal associated with a pattern warning signal from hazard alarm 102. In the embodiment where uninterrupted "0"s are tracked, processor 200 simply multiplies the number of uninterrupted (or near uninterrupted) "0"s that occur between the "1" to "0" transition and the "0" to "1" transition and multiply by the sample period to arrive at the time that the signal from comparator 210 has remained low. Again, this time period is compared to an expected lull time of a temporal signal associated with a pattern warning signal from hazard alarm 102 as stored in memory 202. If a match is found, processor 200 determines that a pattern warning signal is present.

At block 312, processor 200 may determine a type of hazard condition based on a comparison of signal using any of the evaluation embodiments presented above to information stored in memory 202. For example, processor 200 may determine that 4 "pulses" have been detected, indicative of a T-4 cadence, which means that carbon monoxide has been detected by at least one carbon monoxide detector.

At block 314, processor 200 generates an alarm signal indicative that a hazard condition has been detected by one or more hazard alarms 102 and provides the alarm signal to transmitter 216. Processor 200 may also provide an indication of the type of hazard condition detected as determined at block 312. In yet another embodiment, processor 200 may additionally transmit an indication of an identity of the hazard alarm that generated the detected pattern warning signal. This may be accomplished by entering a description of a hazard alarm 102 in proximity to alarm detector 100 using user interface 214. For example, a user could enter "Zone 19", "Smoke Detector in Master Bedroom", "Smoke detector in zone 16", "Carbon monoxide detector in zone 17", or any other description that may help identify a location within a structure that the hazard event is occurring.

At block 316, transmitter 216 transmits the alarm signal generated by processor 200 at block 306 to a remote entity, such as a smartphone and/or security panel 104, indicating that a hazard condition exists that has been detected by hazard alarm 102 and alarm detector 100. The signal may additionally comprise the type of hazard condition sensed, and/or an indication of a location of the hazard or a location or identification of the hazard alarm that detected the hazard condition. In response, the security panel 104 may transmit a signal to a remote monitoring station alerting the remote monitoring station that a hazard condition has been detected and in some embodiments, the type of hazard condition, and/or location of the hazard or a location or identification of the hazard alarm that detected the hazard condition.

At block 318, the processor determines if no audio information has been received from the audio/optical detector 204 and/or comparator 210 within the frequency band of filter 208 for a time period greater than a "long lull" time period associated with one or more temporal patterns, such as 5 seconds, or some other extended period of time. If so, this may indicate that the hazard condition no longer exists. In this case, processor 200 generates an indication of this event and transmits it to the smartphone and/or security panel 104, informing the smartphone and/or security panel 104 that the hazard no longer exists. In response, the security panel 104 may send an indication to the remote monitoring station that the hazard seems to no longer exists.

Therefore, having now fully set forth the preferred embodiment and certain modifications of the concept underlying the present invention, various other embodiments as well as certain variations and modifications of the embodiments herein shown and described will obviously occur to those skilled in the art upon becoming familiar with said underlying concept. It is to be understood, therefore, that the invention may be practiced otherwise than as specifically set forth in the appended claims.

What is claimed is:

1. An apparatus for detecting a pattern warning signal from a hazard alarm and in response thereto sending an alert signal to a home security panel for notification to a remote monitoring station, comprising:

circuitry for converting said pattern warning signal from the hazard alarm into digital values;

a buffer memory for storing the digital values as they are produced by the circuitry;

a memory device for storing processor-executable instructions and at least one temporal pattern characteristic associated with a first temporal pattern;

a processer coupled to the memory device for executing the processor-executable instructions that causes the apparatus to:

perform a number of evaluations of at least some of the digital values stored in the buffer memory to determine when a predetermined number or percentage of the digital values exceed a predetermined threshold number, indicating an energy within a passband of the filter, or to determine when a predetermined number or percentage of the digital values falls below a second predetermined threshold number or percentage, indicating a lack of energy within the passband of the filter;

compare a result of the evaluations to the at least one temporal pattern characteristic; and transmit an alarm signal to the home security panel when the result substantially matches the at least one temporal pattern characteristic.

2. The apparatus of claim 1, wherein the memory device stores at least one temporal pattern characteristic associated with a second temporal pattern, wherein the processor-executable instructions further comprise instructions that cause the apparatus to:

compare the result of the evaluations to the at least one temporal characteristic associated with the second temporal pattern; and determine a type of hazard condition sensed by the hazard alarm based on the comparison;

wherein the alarm signal comprises an indication of the type of hazard condition sensed by the hazard alarm.

3. The apparatus of claim 1, wherein the temporal pattern characteristic comprises a number of peaks within a predetermined time period, wherein the processor-executable instructions that causes the apparatus determine a type of hazard condition sensed by the hazard alarm comprises instructions that cause the apparatus to:

determine a number of times that energy is found within the passband within the predetermined time period;

compare the number of times that energy is found within the passband within the predetermined time period; and determining that a T-3 temporal pattern is present if the number of times that energy is found within the passband within the predetermined time period matches the number of peaks within the predetermined time period.

4. The apparatus of claim 1, wherein the at least one temporal pattern characteristic comprises a long lull time, wherein the processor-executable instructions that causes the apparatus to compare a result of the evaluations to the at least one temporal pattern characteristic comprises instructions that cause the apparatus to:

determine a period of time when the lack of energy is found in the passband;

determine that the result substantially matches the at least one temporal pattern if the time period over which the lack of energy occurs is equal to the long lull time.

5. The apparatus of claim 4, wherein the processor-executable instructions that causes the apparatus to determine a period of time when the lack of energy is found in the passband comprises instructions that cause the apparatus to:

determine a first time when the energy is present in the passband;

determine a second time, after the first time, when the lack of energy is found in passband;

determine a third time, after the second time, when the energy is present in the passband;

determine the time period over which the lack of energy occurs by subtracting the second time from the third time after the first time.

6. The apparatus of claim 1, wherein the temporal pattern characteristic comprises a temporal pattern period, wherein the processor-executable instructions further comprise instructions that causes the apparatus to:

determine a first time period during which the lack of energy is found in the passband;

determine a second time period during which the lack of energy is found in the passband;

determine a time difference between the first time period and the second time period; and transmit the alarm signal to the home security panel when the time difference is equal to the temporal pattern period.

7. The apparatus of claim 6, wherein the memory device stores a second temporal pattern characteristic comprising a long lull period, wherein the processor-executable instructions that cause the apparatus to determine a first time period when the lack of energy is found in the passband and to determine a second time period when the lack of energy is found in the passband further comprises instructions that cause the apparatus to:

determine whether the first time period is equal to the long lull period;

determine whether the second time period is equal to the long lull period; and determine the time difference between the first time period and the second time period when the first and second time period are each equal to the long lull period.

8. An apparatus for detecting a pattern warning signal from a hazard alarm and in response thereto sending an alert signal to a home security panel for notification to a remote monitoring station, comprising:

circuitry for converting the pattern warning signal from the hazard alarm to a stream of digital values;

a memory device for storing processor-executable instructions and a long lull time period associated with a first temporal pattern;

a processer coupled to the memory device for executing the processor-executable instructions that causes the apparatus to:

determine a first time when the stream of digital values transitions from a high state to a low state and then to a high state;

determine a duration of the low state;

compare the duration of the low state to the long lull time period; and determine that a pattern warning signal is present if the duration of the low state is equal to the long lull time period.

9. The apparatus of claim 8, wherein a temporal pattern period associated with the first temporal pattern is also stored in the memory, wherein the processor-executable instructions further comprise instructions that causes the apparatus to:

determine a second time that the stream of digital values transitions from a high state to a low state and then to a high state;

determine a time difference between the second time and the first time; and determine that a pattern warning signal is present if the time difference is equal to the temporal pattern period.

10. The apparatus of claim 8, wherein a temporal period time-out value is stored in the memory device, and the processor-executable instructions that causes the apparatus determine if the pattern warning signal is present comprises instructions that cause the apparatus to:

compare the time difference to the temporal period time-out value; and determine that a pattern warning signal is not present if the time difference exceeds the temporal period time-out value.

11. The apparatus of claim 8, further comprising:

a buffer memory for storing a portion of the stream of digital values;

wherein the processor-executable instructions that cause the apparatus to determine that the stream of digital values transitions from a high state to a low state and then to a high state further comprise instructions that cause the apparatus to:

evaluate at least a portion of the buffer memory at predetermined time periods;

determine that the at least a portion of the buffer memory contains at least a predetermined number or percentage of predetermined digital values;

determine that a high state is present when the at least a portion of the buffer memory contains at least the number or percentage of predetermined digital values;

determine that a low state is present when the at least a portion of the buffer memory contains at least a second predetermined number or percentage of second digital values.

12. An apparatus for detecting a pattern warning signal from a hazard alarm and in response thereto sending an alert signal to a home security panel for notification to a remote monitoring station, comprising:

circuitry for converting said pattern warning signal from the hazard alarm to a digital output stream comprising first digital values and second digital values;

a memory device for storing processor-executable instructions and a temporal pattern period associated with a first temporal pattern;

a processer coupled to the memory device for executing the processor-executable instructions that causes the apparatus to:

determine a first time when the digital output stream transitions from the first digital value to the second digital value and then to the first digital value;

determine a second time when the digital output stream transitions from the first digital value to the second digital value and then to the first digital value;

determine a time difference between the second time and the first time;

compare the time difference to the temporal pattern period; and determine that a pattern warning signal is present if the time difference matches the temporal pattern period.

13. The apparatus of claim 12, wherein a long lull time period associated with the first temporal pattern is also stored in the memory, wherein the processor-executable instructions further comprise instructions that causes the apparatus to:

determine a first duration of the second digital value associated with the first time;

determine a second duration of the second digital value associated with the second time;

compare the first and second durations to the long lull time period; and determine that a pattern warning signal is present if the first and second durations equal the long lull time period.

14. The apparatus of claim 12, further comprising:

a buffer memory for storing a number of said first and second digital values as they are produced by the analog-to-digital converter;

wherein the processor-executable instructions further comprise instructions that causes the apparatus to:

sample the buffer memory at predetermined time intervals;

assign a high state to the buffer if a number or percentage of memory locations in the buffer memory comprising the first digital value exceed a first predetermined threshold;

assign a low state to the buffer if a number or percentage of the memory locations in the buffer memory comprising the second digital value exceed a second predetermined threshold;

wherein the transitions from the first digital value to the second digital value and then to the first digital value comprise transitions from a first high state to the low state and then to the high state.

15. A method performed by an alarm detector, comprising:

converting an audible pattern warning signal from a hazard alarm to a digital output stream comprising first digital values and second digital values determining a first time when the digital output stream transitions from the first digital value to the second digital value and then to the first digital value;

determining a second time when the digital output stream transitions from the first digital value to the second digital value and then to the first digital value;

determining a time difference between the second time and the first time;

comparing the time difference to the temporal pattern period; and determining that a pattern warning signal is present if the time difference matches the temporal pattern period.

16. The method of claim 15, further comprising:

determining a first duration of the second digital value associated with the first time;

determining a second duration of the second digital value associated with the second time;

comparing the first and second durations to the long lull time period; and determining that a pattern warning signal is present if the first and second durations equal the long lull time period.

17. The method of claim 15, further comprising:

storing a number of said first and second digital values in a buffer memory as they are produced by an analog-to-digital converter;

sampling the buffer memory at predetermined time intervals;

assigning a high state to the buffer if a number or percentage of memory locations in the buffer memory comprising the first digital value exceed a first predetermined threshold;

assigning a low state to the buffer if a number or percentage of the memory locations in the buffer memory comprising the second digital value exceed a second predetermined threshold;

wherein the transitions from the first digital value to the second digital value and then to the first digital value comprise transitions from a first high state to the low state and then to the high state.

* * * * *